US007981259B2

(12) United States Patent
Hafezi et al.

(10) Patent No.: US 7,981,259 B2
(45) **Date of Patent: *Jul. 19, 2011**

(54) ELECTROLYTIC CAPACITOR FOR ELECTRIC FIELD MODULATION

(75) Inventors: Hooman Hafezi, Redwood City, CA (US); Aron Rosenfeld, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1262 days.

This patent is subject to a terminal disclaimer.

(21) Appl. No.: 11/452,839

(22) Filed: Jun. 14, 2006

(65) Prior Publication Data

US 2007/0289871 A1 Dec. 20, 2007

(51) Int. Cl.

| | |
|---|---|
| ***C25D 5/00*** | (2006.01) |
| ***C25D 17/00*** | (2006.01) |
| ***C25D 21/12*** | (2006.01) |
| ***B23H 7/14*** | (2006.01) |
| ***C25B 9/00*** | (2006.01) |
| ***C25B 9/04*** | (2006.01) |
| ***C25B 15/00*** | (2006.01) |
| ***C25C 3/16*** | (2006.01) |
| ***C25C 3/20*** | (2006.01) |
| ***C25F 7/00*** | (2006.01) |

(52) U.S. Cl. ..... 204/230.7; 205/96

(58) Field of Classification Search ..... 205/260, 205/652, 316, 96, 60; 204/290.12, 230.7
See application file for complete search history.

(56) References Cited

U.S. PATENT DOCUMENTS

| | | | | |
|---|---|---|---|---|
| 4,855,020 | A * | 8/1989 | Sirbola | 205/137 |
| 6,004,440 | A | 12/1999 | Hanson et al. | |
| 6,168,693 | B1 * | 1/2001 | Uzoh et al. | 204/229.4 |
| 6,168,694 | B1 * | 1/2001 | Huang et al. | 204/290.12 |
| 6,228,232 | B1 | 5/2001 | Woodruff et al. | |
| 6,261,433 | B1 * | 7/2001 | Landau | 205/96 |
| 6,270,647 | B1 | 8/2001 | Graham et al. | |
| 6,423,206 | B1 * | 7/2002 | Haby et al. | 205/652 |
| 6,436,249 | B1 | 8/2002 | Patton et al. | |
| 6,627,051 | B2 | 9/2003 | Berner et al. | |
| 6,921,468 | B2 * | 7/2005 | Graham et al. | 204/212 |
| 7,563,354 | B2 * | 7/2009 | Timonov et al. | 205/316 |
| 2002/0125140 | A1 | 9/2002 | Uzoh et al. | |
| 2003/0079995 | A1 | 5/2003 | Contolini et al. | |
| 2004/0226826 | A1 | 11/2004 | Cheng et al. | |
| 2006/0243598 | A1 * | 11/2006 | Singh et al. | 205/260 |

OTHER PUBLICATIONS

Frackowiak, et al article. "Carbon Materials for the Electrochemical Storage of Energy in Capacitors", Carbon 39 (2001) pp. 937-950.

Yang, et al article. "Electrosorption Capacitance of Nanostructured Carbon Aerogel Obtained by Cyclic Voltammetry", Journal of Electroanalytical Chemistry 540 (2003), pp. 159-167.

* cited by examiner

*Primary Examiner* — Harry D Wilkins, III
*Assistant Examiner* — Michael Band
(74) *Attorney, Agent, or Firm* — Patterson & Sheridan, L.L.P.

(57) ABSTRACT

A method and apparatus for adjusting an electric field of an electrochemical processing cell are provided. In one embodiment, a capacitive element is disposed in the processing solution. The strength, shape, or direction of the electric field in the processing solution may be modulated by charging and discharging the capacitive element in a controlled manner. Because the electric field is modulated with out passing a current from the capacitive element to the processing solution, electrochemical reactions do not occur on the interface of the capacitive element and the processing solution, thus, reduces complications caused by unwanted electrochemical reactions.

19 Claims, 8 Drawing Sheets

ELECTROLYTIC CAPACITOR FOR ELECTRIC FIELD MODULATION

BACKGROUND OF THE INVENTION

1. Field of the Invention

Embodiments of the invention generally relate to methods and apparatus for modulating of electric field in an electrochemical process. One embodiment of the invention relates to an electrolytic capacitor disposed in an electrochemical processing cell, wherein the electrolytic capacitor is configured to modulate the electric field without inducing deleterious electrochemical reactions.

2. Description of the Related Art

Metallization of high aspect ratio 90 nm and smaller sized features, such as 45 nm, is a foundational technology for future generations of integrated circuit manufacturing processes. Metallization of these features is generally accomplished via an electrochemical plating process. However, electrochemical plating of these features presents several challenges to conventional gap fill methods and apparatuses. One such problem, for example, is that electrochemical plating processes generally require a conductive seed layer to be deposited onto the features to support the subsequent plating process. Conventionally, these seed layers have had a thickness of between about 1000 Åand about 2500 Å; however, as a result of the high aspect ratios of 90 nm features, seed layer thicknesses must be reduced to less than about 300 Å. This reduction in the seed layer thickness has been shown to cause a "terminal effect," which is generally understood to be decrease in the deposition rate of an electrochemical plating (ECP) process as a function of the distance from the electrical contacts at the edge of a substrate being plated. The impact of the terminal effect is that the deposition thickness near the edge of the substrate is substantially greater than the deposition thickness near the center of the substrate. The increase in deposition thickness near the edge of the substrate as a result of the terminal effect presents difficulties to subsequent processes, e.g., polishing, bevel cleaning, etc., and as such, minimization of the terminal effect is desired.

Attempts have been made to use conventional plating apparatus and processes to overcome the terminal effect through various apparatus and methods. Conventional configurations have been modified to include passive shield or flange members, or segmented anodes configured to control the terminal effect. These configurations were generally unsuccessful in controlling the terminal effect, which resulted in poor control over the deposition thickness near the perimeter.

Active thief electrodes have been used to adjust the current density near the perimeter of a substrate during a plating process to overcome the terminal effect generated by thin seed layers in electrochemical plating processes. An active thief electrode in conventional plating cells is generally configured to pass a current into the solution using an independent power supply. The current passed from the active thief modulates the strength, shape, or direction of the electric field in the solution to achieve desired results. Because a current passes from the thief/auxiliary electrode to the solution, an electrochemical reaction occurs at the interface between the electrode and the solution. This electrochemical reaction may cause several undesired complications. For example, the electrode may need to be cleaned and/or replaced frequently, defects may generate loose metal particles and other products from the electrochemical reaction, and bath additives may be electrochemically broken down.

Therefore, there exists a need for an apparatus and a method for overcoming he terminal effect without unwanted complications during an electrochemical processing.

SUMMARY OF THE INVENTION

The present invention is directed to an electrochemical plating cell with a capacitive element that satisfies these needs. One embodiment of the invention provides an apparatus for electrochemically processing a substrate with an electrolyte. The apparatus comprises a capacitive element in contact with the electrolyte, wherein the capacitive element is independently biased from the substrate. The apparatus further comprises a substrate support member configured to support the substrate, and a counter electrode in contact with the electrolyte, wherein the counter electrode is coupled to a power supply configured to provide an electric bias between the substrate and the counter electrode.

Embodiments of the invention further provide an apparatus for electroplating a substrate. The apparatus comprises a fluid basin configured to contain a plating solution therein, an anode in fluid communication with the plating solution, wherein the anode is adapted to a power supply configured to apply a plating bias between the anode and the substrate, and a capacitive element in fluid communication with the plating solution.

Another embodiment of the invention further provides a method for processing a substrate electrochemically with an electrolyte. The method comprises providing a counter electrode in contact with the electrolyte, providing a capacitive element in contact with the electrolyte, contacting the substrate with the electrolyte, processing the substrate by applying an electric bias between the substrate and the counter electrode, and passing a current to the capacitive element during processing the substrate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION OF THE PREFERRED EMBODIMENT

The present invention generally provides an electrochemical plating cell, with an encased counter electrode assembly in fluid communication with the cathode compartment, configured to uniformly plate metal onto a substrate.

Figure 1:
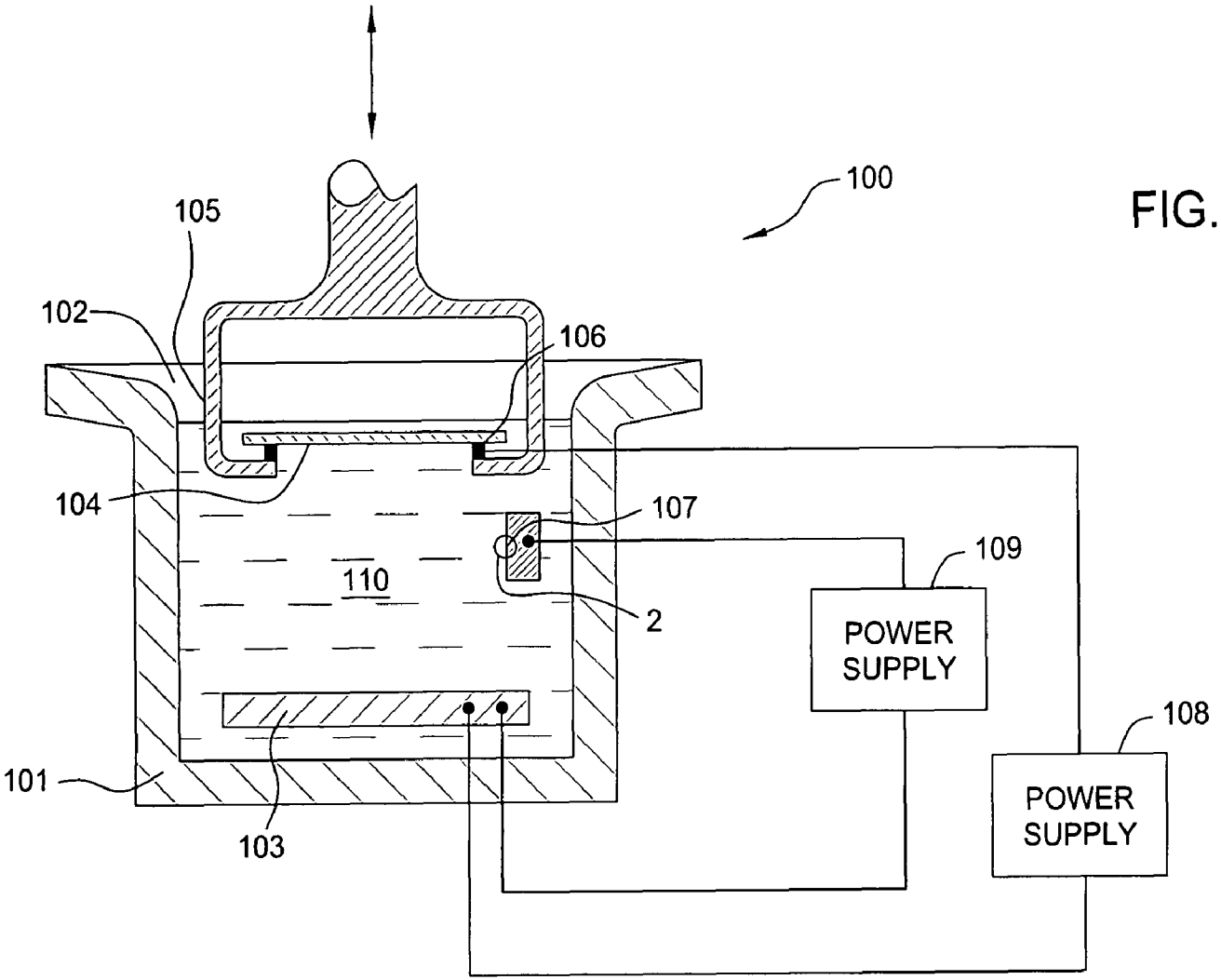
FIG. 1 illustrates a schematic view of one embodiment of an electrochemical processing cell of the present invention.

FIG. 1 illustrates a schematic view of an electrochemical processing cell 100. An electric field in the electrochemical processing cell 100 may be adjusted without having to pass a current into the electrolyte. The electrochemical processing cell 100 generally comprises a fluid volume 102 configured to contain an electrolyte 110. In one embodiment, the fluid volume 102 is defined by a fluid basin 101. In other embodiments, the fluid volume 102 may be defined by a permeable and porous structure, for example, a polishing pad in an electrochemical polishing system. Two electrodes are configured to be in contact with the electrolyte 110 contained in the fluid volume 102 during process. In one embodiment, a counter electrode 103 is disposed in the fluid basin 101 and a substrate support member 105 is configured to form a working electrode along with a substrate 104 supported therein. The substrate support member 105 and the substrate 104 are in electrical contact on via one or more contact pins 106. The substrate support member 105 is configured to transport the substrate 104 in and out the fluid volume 102.

A processing power supply 108 is coupled between the substrate support member 105 and the counter electrode 103. In one embodiment, the electrochemical processing cell 100 is configured to electroplate a metal layer on the substrate 104, thus the substrate support member 105 is cathodically biased and the counter electrode 103 serves as an anode. In another embodiment, the electrochemical processing cell 100 is configured to electropolishing a metal layer from the substrate 104, thus the substrate support member 105 is positively biased, and the counter electrode 103 is negatively biased. It should be noted that electroplating and electropolishing processes can be performed alternatively in the electrochemical processing cell 100 by simply alternating directions of the processing power supply 108.

During processing, an electric field may be generated between the counter electrode 103 and the assembly of the substrate 104 and the substrate support member 105. A capacitive element 107 is disposed in the fluid volume 102 and configured to have an interface in contact with the processing electrolyte during processing. The capacitive element 107 may be charged and discharged by a capacitor power supply 109. In one embodiment, the power supplies 108 and 109 may be independent controllable outputs of a multiple power supply.

The capacitive element 107 is configured to have a large surface area and high electrolytic capacitance. When the capacitive element 107 is charged, a large amount of charge can be stored within the interface of the capacitive element 107 and the electrolyte. Therefore, the strength, shape, or direction of the electric field in the fluid volume 102 may be modulated by charging and discharging the capacitive element 107 disposed therein.

Figure 2A:
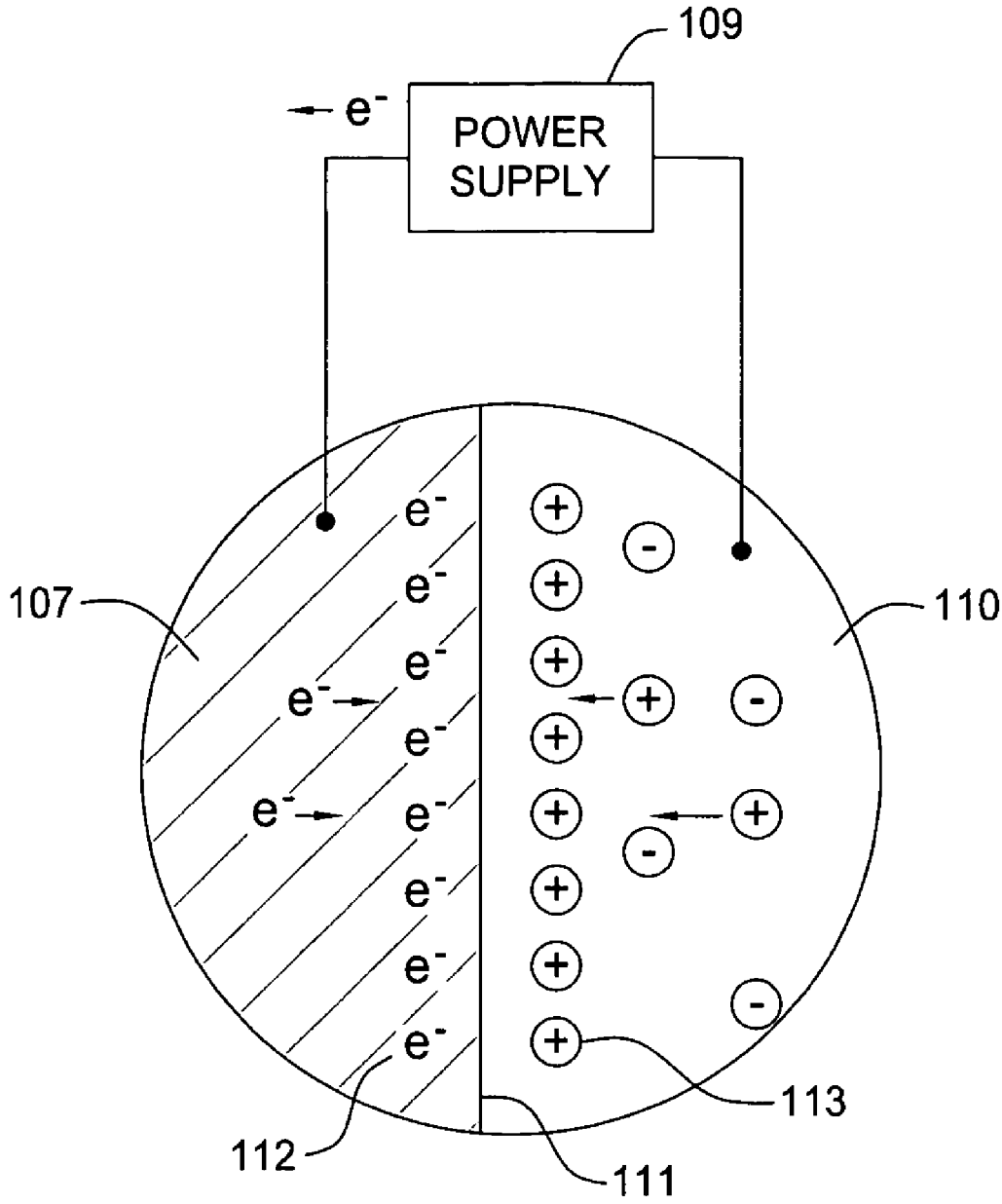
FIG. 2A illustrates enlarged view of an interface of an electrolytic capacitor and an electrolyte of the electrochemical processing cell of FIG. 1.
Figure 2B:
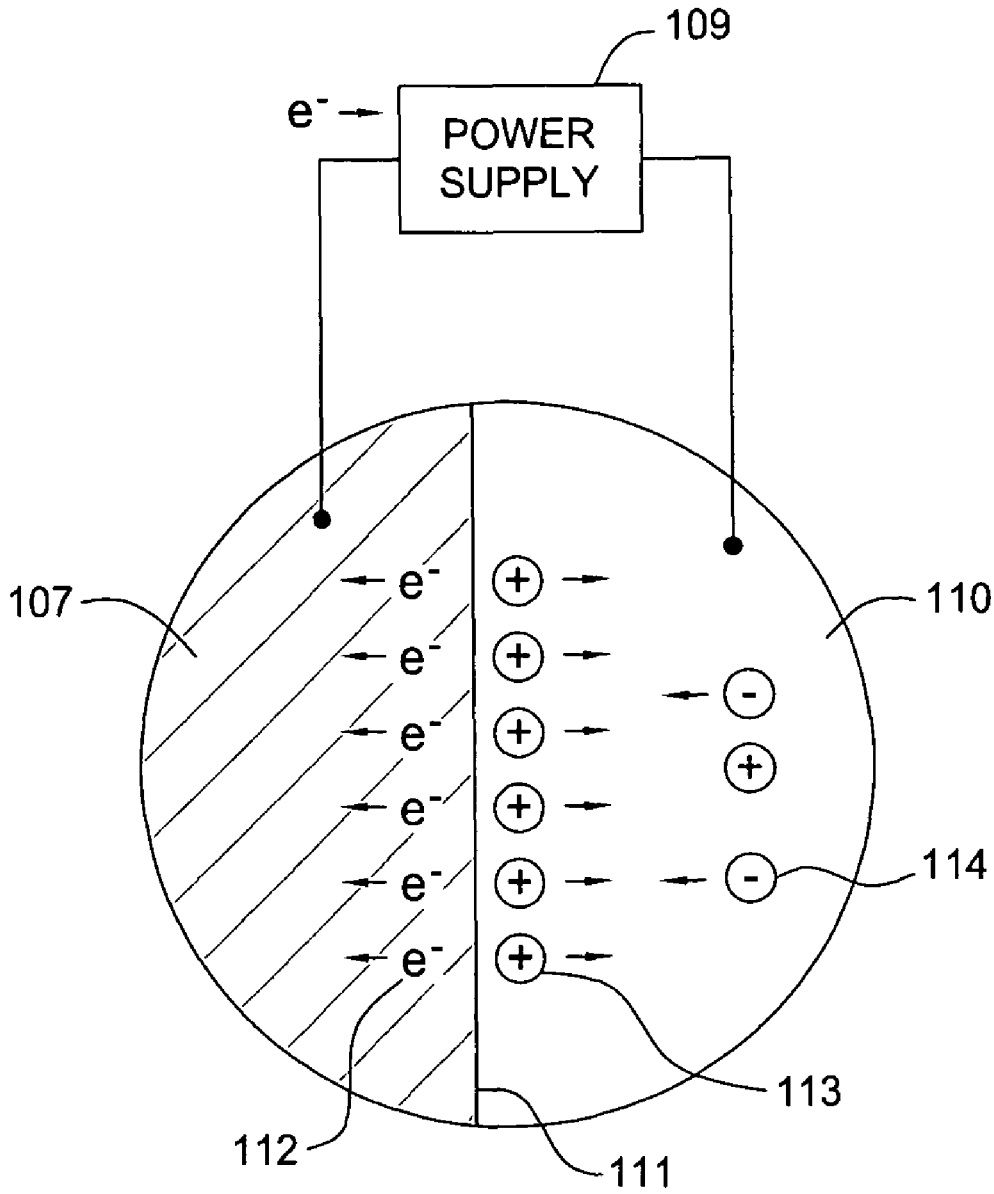
FIG. 2B illustrates enlarged view of an interface of an electrolytic capacitor and an electrolyte of the electrochemical processing cell of FIG. 1.

FIGS. 2A and 2B illustrate enlarged views of an interface of the capacitive element 107 and the electrolyte 110 of the electrochemical processing cell 100 shown in FIG. 1. The capacitive element 107 has a surface 111 which is in contact with the electrolyte 110. The electrolyte 110 contains positive ions 113 and negative ions 114.

In FIG. 2A, the capacitive element 107 is being charged negatively. A current of electrons is flowing into the capacitive element 107 from the capacitor power supply 109. Electrons 112 accumulate inside the capacitive element 107 near the surface 111. The electrons 112 attract the positive ions 113 in the electrolyte 110 producing positive-negative poles disturbed relative to each other across the surface 111 over an extremely short distance. This phenomenon is known as an "electrical double-layer". While the positive ions 113 are flowing to the surface 111, a current is generated in the electrolyte 110 near the surface 111. The current can be supplied to the capacitive element 107 in such a way that voltage difference between the capacitive element 107 and the electrolyte 110 do not exceed an overvoltage for the onset of faradic reactions, such as metal depositions and breakdown of electrolytic compound, in the electrolyte 110. Hence, faradic reactions do not occur near the surface 111. In one embodiment, the voltage of the capacitive element 107 may be controlled by flowing a predetermined current for a predetermined period of time using the following relation:

$$i = C\frac{dV}{dt} \tag{1}$$

wherein i denotes current, C denotes capacitance, V denotes electric potential, and t denotes time. Therefore, the electric field in the electrolyte 110 can be modified by charging the capacitive element 107 disposed therein without inducing electrochemical reactions.

Similarly, the electric field of the electrolyte 110 may be adjusted while the charged capacitive element 107 is being discharged. As shown in FIG. 2B, the electrons 112 are flowing out of the capacitive element 107 while a current is applied. The "electrical double-layer" neutralizes or switches signs releasing the positive ions 113 back to the electrolyte 110, thus, creates another current in the electrolyte 110.

In one embodiment, the capacitive element 107 may consist of a highly porous material, such as carbon aerogels, embedded in an inert but conductive matrix such as carbon paper. A carbon aerogel is a monolithic three-dimensional mesoporous network of carbon nanoparticles obtained by pyrolysis of organic aerogels based on resorcinol-formaldehyde. Carbon aerogels have high surface area (on the order of several $m^2/g$), low density, good electrical conductivity, high electrolytic capacitance (several F/g). It should be noted that other materials can also be used to make a capacitive element for an electrochemical system. In one embodiment, the capacitive element 107 may be encased in a polymeric sheath.

Through proper optimization of geometry, conductivity and capacitance, a capacitive structure, such as the capacitive element 107 in FIG. 1, may be used in an electrochemical processing system to modulate the strength, shape or direction of the processing electric field to achieve desired results, such as improving deposit uniformity, protecting substrates from corrosion, or enabling nucleation for an electrodeposition process. The capacitive element s of the present invention may be used to achieve different purposes by using different designs, applying different charging/discharging sequences, or positioning in different locations.

Figure 3:
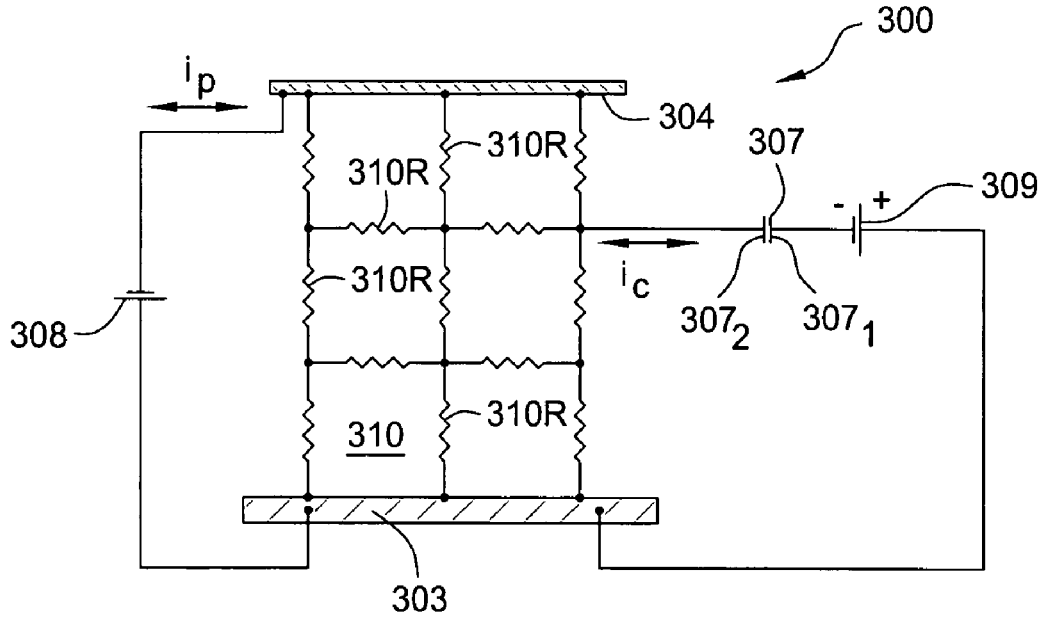
FIG. 3 illustrate a schematic circuit of one embodiment of an electrochemical processing cell of the present invention.

FIG. 3 illustrates one embodiment of an electrochemical processing cell of the present invention in form of an electronic circuit 300. A substrate 304 having a layer of conductive material on a surface is generally connected to a processing power supply 308. The power supply 308 is further connected to a counter electrode 303 disposed in an electrolyte 310. The electrolyte 310 may be considered as a network of resistors 310R. When the substrate 304 is immerged into the electrolyte 310, the substrate 304, the processing power supply 308, the counter electrode 303 and the network of resisters 310R form a closed circuit, and a processing current $i_p$ flows in the closed circuit for processing, i.e., plating and/or deplating, the conductive layers on the substrate 304.

A capacitive element disposed in the electrolyte 310 is equivalent of a capacitor 307 having a first electrode $\mathbf{307}_1$ and a second electrode $\mathbf{307}_2$. Generally, the first electrode 307, is a chargeable area inside the surface of the capacitive element and the second electrode $\mathbf{307}_2$ is a chargeable area outside the capacitor element in the electrolyte 310. The capacitor 307 forms another circuit with the network of resisters 310R, the counter electrode 303 and a capacitor power supply 309. When the capacitor 307 is charged or discharged, a capacitor current $i_c$ flows between the networks of the resisters 310R and the capacitor 307. The capacitor current $i_c$ alters the electric fields in the electrolyte 310, therefore, changing the processing current $i_p$ at least in the region near the capacitor element.

As shown in FIG. 3, the first electrode $\mathbf{307}_1$, is connected to the negative terminal of the capacitor power supply 309, thus the first electrode $\mathbf{307}_1$ is configured to be charged negatively. During a charging process, the current $i_c$ flows from the network of resisters 310 to the second electrode $\mathbf{307}_2$. During a discharge processing, the current $i_c$ flows from the second electrode $\mathbf{307}_2$ to the network of resisters 310. It should be noted that the capacitor power supply 309 may be connected in a reversed manner so that the capacitor 307 can be charged either positively or negatively.

A capacitor element may be used to achieve different effects to an electrochemical processing cell depending charging and discharging sequences applied to the capacitor. More detailed description may be found in FIGS. 5A-D.

Figure 4:
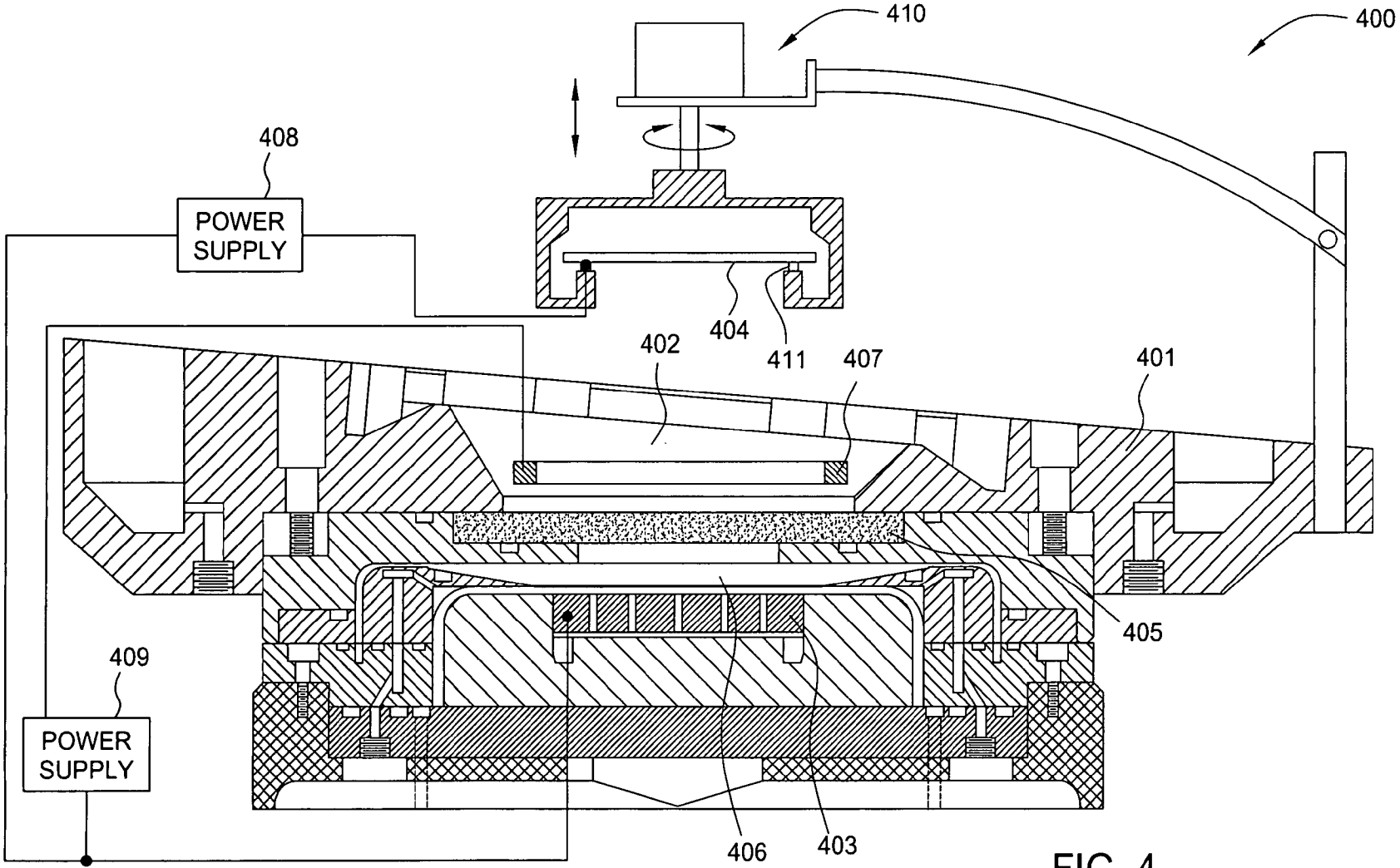
FIG. 4 illustrates a sectional view of one embodiment of an electroplating cell of the present invention.

FIG. 4 illustrates a sectional view of one embodiment of an electrochemical processing cell 400. The electrochemical processing cell 400 is illustratively described below in reference to modification of a SlimCell™ system, available from Applied Materials, Inc., Santa Clara, Calif. Detailed description of an electroplating cell used in a SlimCell™ may be found in co-pending U.S. patent application Ser. No. 10/268,284, filed on Oct. 9, 2002, entitled "Electrochemcial Processing Cell", which is herein incorporated by reference.

The electrochemical processing cell 400 generally includes a basin 401 defining a processing volume 402 configured to contain a plating solution. An anode 403 is generally disposed near the bottom of the processing volume 402. In one embodiment, a membrane assembly 406 containing an ionic membrane is generally disposed on top of the anode 403 forming an anodic chamber near the anode 403. A diffuser plate 405 configured to direct the fluid flow in the processing volume 402 may be positioned above the membrane assembly 406. The electrochemical processing cell 400 further comprises a substrate support member 410 configured to transfer a substrate 404 and contact the substrate 404 electrically via one or more contact pins 411 near the edge of the substrate 404. A processing power supply 408 is coupled between the contact pins 411 and the anode 403.

During processing, the substrate support member 410 transders the substrate 404 into the processing volume 402 so that the substrate 404 is in contact with or immerged in a plating solution contained therein. The processing power supply 408 provides the substrate 404, via the contact pins 411, a plating bias relative to the anode 403. An electric field is generated between the substrate 404 and the anode 403 and one or more conductive materials may be plated on the substrate 404.

In one embodiment, a capacitive element 407 is disposed in the processing volume 402. The capacitive element 407 is configured to adjust the electric field between the substrate 404 and the anode 403. In one embodiment, the capacitive element 407 is shaped like a ring and positioned in a way that when the substrate 404 is in processing position, the capacitive element 407 is near the edge of the substrate 404. In one embodiment, the capacitive element 407 is connected to a capacitor power supply 409 which is also connected to the anode 403. The capacitor power supply 409 is configured to charge and discharge the capacitive element 407. In another embodiment, the capacitor power supply 409 is in electrical communication with the contact pins 411 and the capacitive element 407. In one embodiment, the capacitive element 407 is configured to adjust the electric field between the substrate 404 and the anode 403 during electroplating to improve plating uniformity.

It should be noted that the capacitor element 407 may have a variety of shapes and locations in an electrochemical processing cell. For example, the capacitor element 407 may include a plurality of capacitors in strips, or a continuous ring, or other shapes. The capacitor element 407 may be disposed on the diffuser plate 405, attached to the substrate support member 410 near the contact pins 411, or near the substrate.

An electroplating process performed in an electroplating cell, such as the electrochemical processing cell 400, may be generally divided into four stages. In stage I, a substrate support member, such as the substrate support member 410, is in a non-process position, and a substrate may be loaded into the substrate support member. In stage II, the substrate support member transfer and immerge the substrate into a plating solution in a processing volume, such as the processing volume 402 of FIG. 4. In stage III, a plating process is performed by applying a plating bias to the substrate an anode by a processing power supply, such as the processing power supply 408 of FIG. 4. In stage IV, the plating process is completed and the substrate support member transferred the substrate out of the plating solution.

Different effects on plating results may be achieved by charging/discharging a capacitor element at different stages of the plating process. FIGS. 5A-D illustrates exemplary charging/discharging sequences for a capacitor element used in an electrochemical processing cell of the present invention.

Figure 5A:
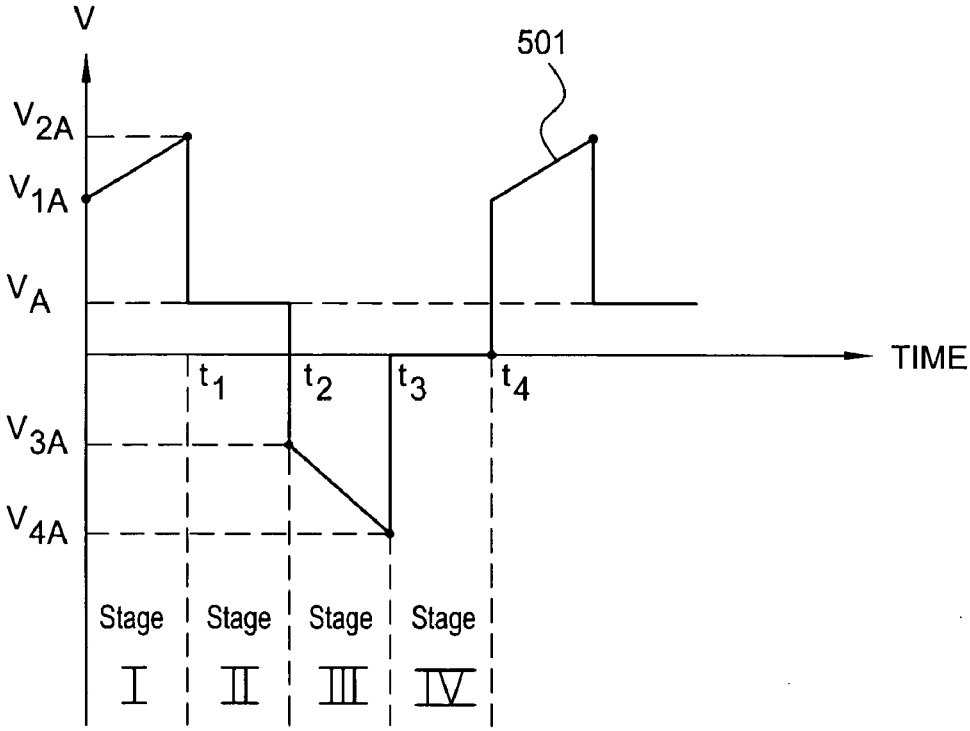
FIGS. 5A-D illustrates exemplary charging/discharging sequences for an electrolytic capacitor used in an electroplating cell of the present invention.

FIG. 5A illustrates an exemplary charging/discharging sequence for a capacitor element, such as the capacitor element 407 of FIG. 4, during an electroplating process. The horizontal axis indicates time and the vertical axis indicates voltage. The stages I-IV indicate the plating stages described above. Curve 501 represents changes of supply voltage supplied to the capacitor element 407 by the capacitor power supply 409 during the plating process. In stage I, from time zero to t1, the curve 501 increases from $V_{1A}$ to $V_{2A}$, indicating the capacitive element 407 is being charged positively. In one embodiment, the charging may be performed by supplying to the capacitive element 407 a predetermined current for a predetermined time period. In stage I, the substrate 404 is not in contact with the electrolyte. In stage II, when the substrate 404 is being immersed into the electrolyte, the capacitive element 407 is kept in the positively voltage $V_A$. In stage III, the plating processing starts in the electrochemical processing cell 400 and the capacitive element 407 is discharged as a function of time in a controlled manner to adjust the electric field in the vicinity of the capacitive element 407, i.e. near the edge of the substrate. In one embodiment, the voltage is lowered from $V_{3A}$ to $V_{4A}$ in a linear manner as discharge continues. In one embodiment, the discharge continuous until the capacitive element 407 reaches a neutral condition or a predetermined voltage. In one aspect, the discharge of the capacitive element 407 may cover the whole process of plating. In another aspect, the discharge may only occur at the beginning of the plating process when the seed layer is thin and the terminal effect is most obvious. In stage IV, the capacitive element 407 is kept static, for example in the neutral condition, while the plating process is completing and the substrate 404 is removed from the electrolyte. The charge and discharge process may start again for a new substrate to be plated.

In the sequence shown in FIG. 5A, during electroplating, a positively charged capacitive element is discharged negatively, which generates a current towards the capacitive element in the electrolyte, therefore reducing a plating rate near the capacitive element.

Figure 5B:
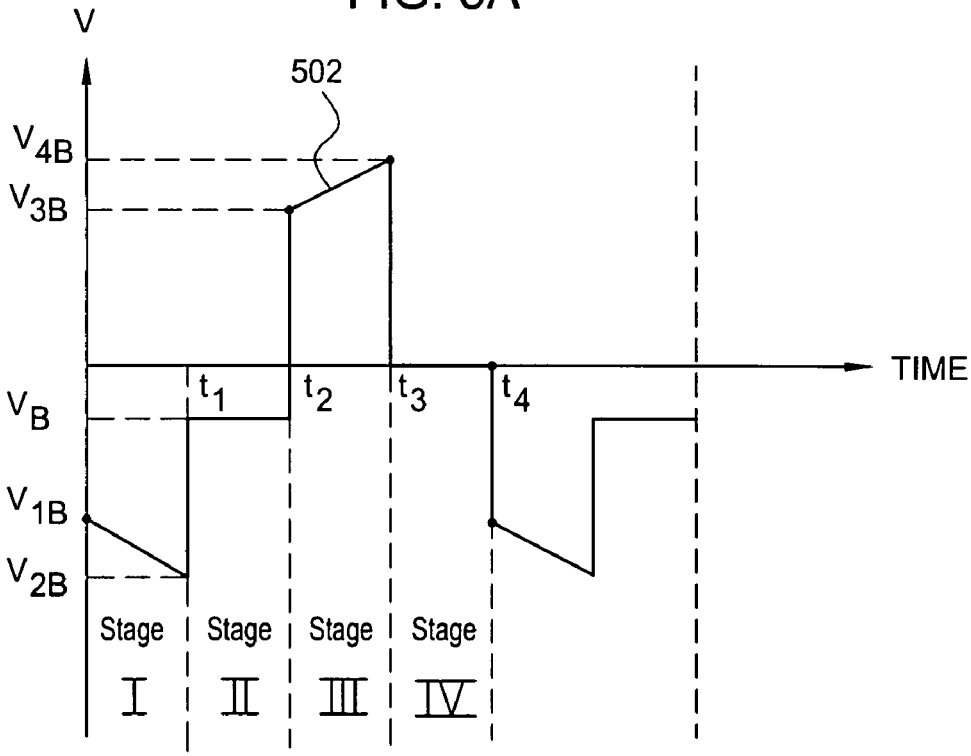

FIG. 5B illustrates another exemplary charging/discharging sequence for a capacitor element, such as the capacitor element 407 of FIG. 4, during an electroplating process. Curve 502 represents changes of supply voltage supplied to the capacitor element by the capacitor power supply 409 during the plating process. In stage I, while the substrate is not in the electrolyte, the curve 502 decreases from $V_{1B}$ to $V_{2B}$, indicating the capacitive element 407 is being charged negatively. In stage II, when the substrate 404 is being immersed into the electrolyte, the capacitive element 407 is kept in the negatively charged voltage VB. In stage II, the plating processing starts in the electrochemical processing cell 400 and the capacitive element 407 is discharged as a function of time in a controlled manner. In stage IV, the capacitive element 407 is kept static, for example in the neutral condition, while the plating process is completing and the substrate 404 is removed from the electrolyte. The charge and discharge process may start again for a new substrate to be plated.

In the sequence shown in FIG. 5B, during electroplating, a negatively charged capacitive element is discharged positively, which generates a current outward from the capacitive element in the electrolyte, therefore increasing a plating rate near the capacitive element.

Figure 5C:
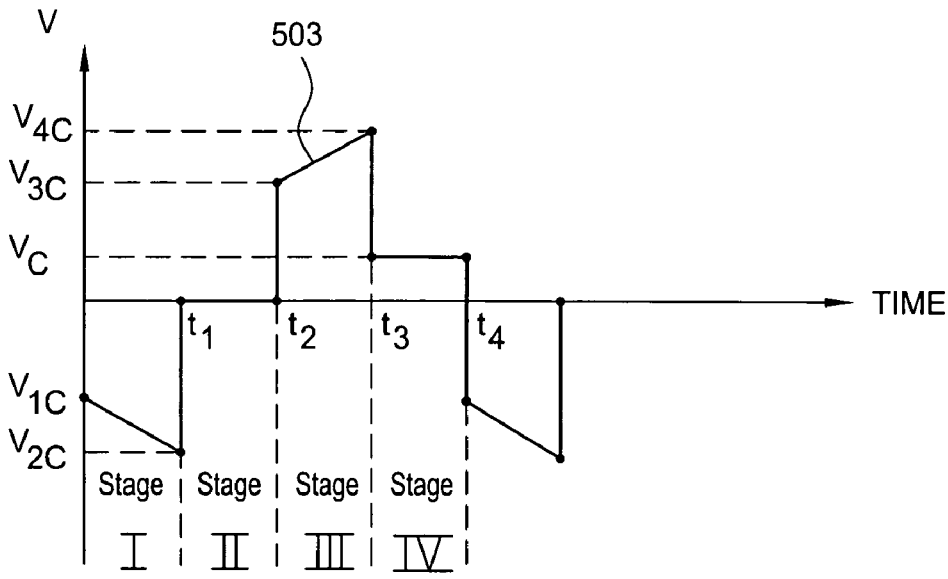

Similarly, in the sequence shown in FIG. 5C, the capacitive element is discharged in stage I and charged positively in stage III, i.e. the plating stage. Therefore, during electroplating, a capacitive element is positively charged, which generates a current outward from the capacitive element in the electrolyte, therefore increasing a plating rate near the capacitive element.

Figure 5D:
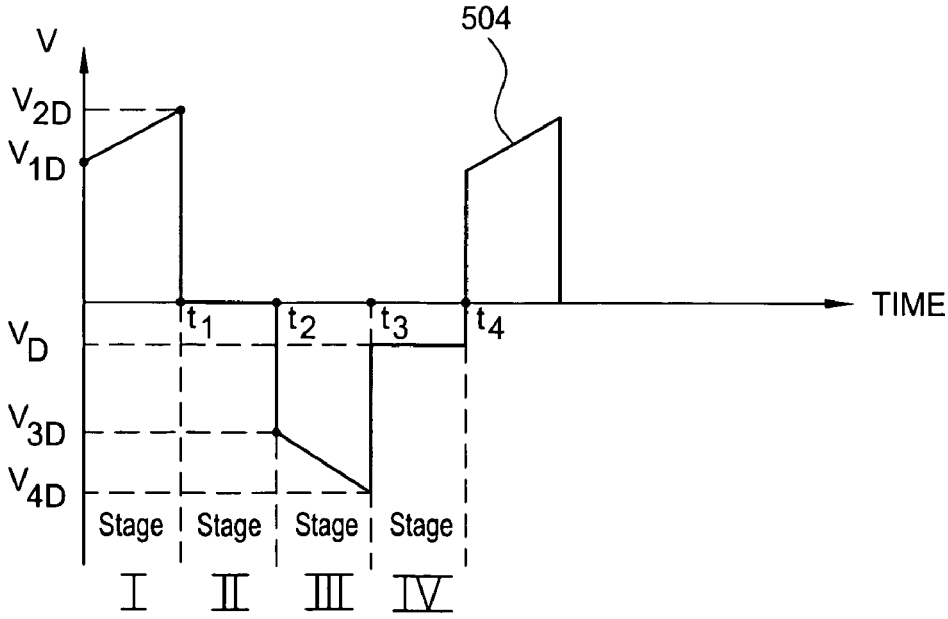

In the sequence shown in FIG. 5D, the capacitive element is discharged in stage I and charged negatively in stage III, i.e. the plating stage. Therefore, during electroplating, a capacitive element is negatively charged, which generates a current towards the capacitive element in the electrolyte, therefore decreasing a plating rate near the capacitive element.

Figure 6:
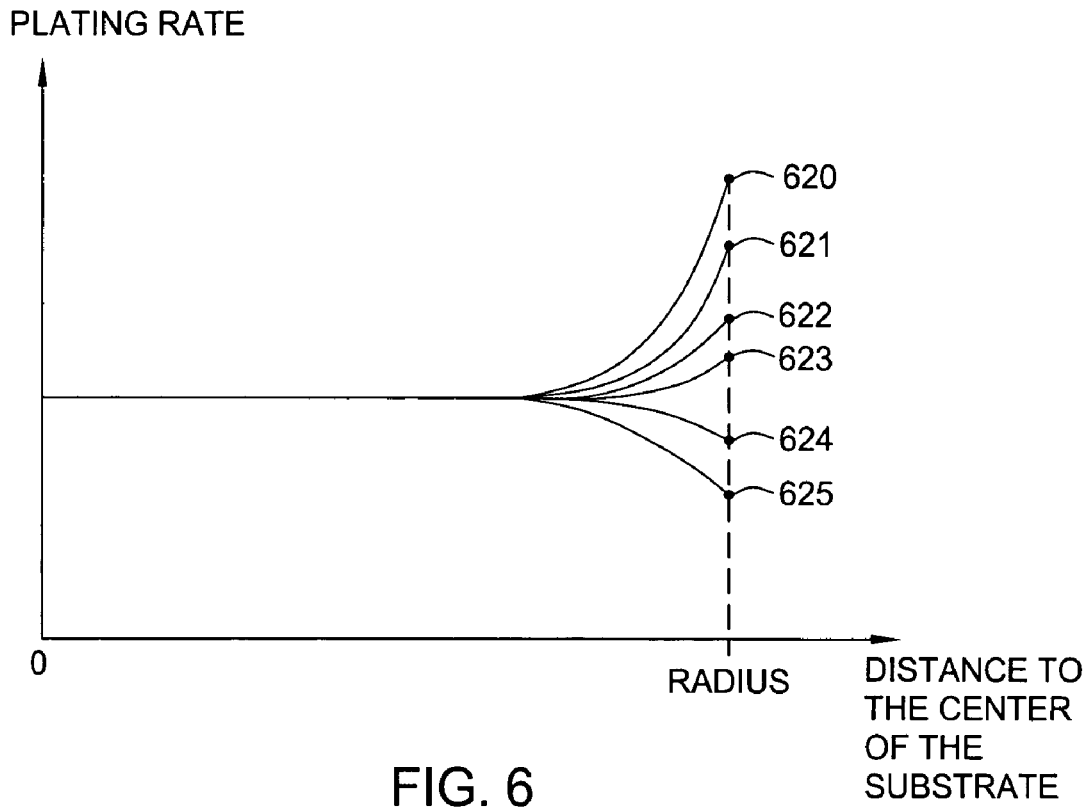
FIG. 6 illustrates exemplary profiles of plating rate may be obtained by the electroplating cell of the present invention.

As described in FIGS. 5A-D, a capacitive element in an electroplating cell may be used to adjust the electric field of the electroplating cell, hence adjusting a plating rate near the capacitive element. FIG. 6 illustrates exemplary profiles of plating rates that may be obtained by an electroplating cell having a capacitive element near the edge of the substrate being processed. The horizontal axis indicates the distance from the center of the substrate and the vertical axis indicates a plating rate. Curves 620-625 illustrate a plurality of plating rate profiles along a radius of the substrate being processed. The curves 620-625 illustrate plating effects ranged from edge thick to edge thin which may be applied to different substrates or during a different time period of the plating process. The curves 620-625 may be obtained by charging/discharging a capacitive element near the edge of the substrate at different current settings or directions.

It should be noted that the present invention may be used to achieve good quality metal deposition, for example deposition with a uniform profile. The present invention may also be used to achieve specific deposition profiles, such as an intentionally non-uniform profile. The present invention may also be used for corrosion protection, for example by applying a protective bias to the substrate through the capacitive element.

While the foregoing is directed to embodiments of the present invention, other and further embodiments of the invention may be devised without departing from the basic scope thereof, and the scope thereof is determined by the claims that follow.

What is claimed is:

1. An apparatus for electrochemically processing a substrate with an electrolyte, comprising:

a capacitive element having a surface in contact with the electrolyte, wherein the capacitive element is independently biased from the substrate, the capacitive element disposed in the electrolyte forms a capacitor having a first chargeable area inside the surface of the capacitive element and a second chargeable area outside the capacitor element in the electrolyte, and the capacitive element is connected to a charging power supply configured to charge and discharge the capacitive element in a controlled manner without inducing electrochemical reactions.

2. The apparatus of claim 1, wherein the capacitive element comprises a highly porous material embedded in an inert conductive matrix.

3. The apparatus of claim 2, further comprising:

a substrate support member configured to support the substrate; and a counter electrode in contact with the electrolyte, wherein the counter electrode and substrate support are coupled to a power supply configured to provide an electric bias between the substrate and the counter electrode.

4. The apparatus of claim 3, further comprises a fluid basin configured to contain the electrolyte, wherein the counter electrode and the capacitive element are disposed in the fluid basin.

5. The apparatus of claim 4, wherein the capacitive element is disposed near a periphery of the substrate.

6. The apparatus of claim 4, wherein the fluid basin is divided by an ionic membrane into a cathode chamber and an anode chamber, the capacitive element is disposed in the cathode chamber and the counter electrode is disposed in the anode chamber.

7. The apparatus of claim 4, wherein the fluid basin comprises a diffuser plate and the capacitive element is disposed on the diffuser plate.

8. The apparatus of claim 1, wherein the capacitive element is charged and discharged to achieve a desired profile across the substrate.

9. The apparatus of claim 1, wherein the capacitive element is made from materials with high surface area and high electrolytic capacitance.

10. The apparatus of claim 2, wherein the highly porous material of the capacitive element is carbon aerogel.

11. The apparatus of claim 2, wherein the capacitive element is encased in a polymeric sheath.

12. An apparatus for electroplating a substrate, comprising a fluid basin configured to contain a plating solution therein;

an anode in fluid communication with the plating solution, wherein the anode is adapted to a power supply configured to apply a plating bias between the anode and the substrate; and a capacitive element having a surface in contact with the electrolyte, wherein the capacitive element is independently biased from the substrate, the capacitive element disposed in the electrolyte forms a capacitor having a first chargeable area inside the surface of the capacitive element and a second chargeable area outside the capacitor element in the electrolyte, and the capacitive element is connected to a charging power supply configured to charge and discharge the capacitive element in a controlled manner without inducing electrochemical reactions.

13. The apparatus of claim 12, wherein the capacitive element comprises a highly porous material embedded in an inert conductive matrix.

14. The apparatus of claim 13, the fluid basin is divided by an ionic membrane into a cathode chamber and an anode chamber, the capacitive element is disposed in the cathode chamber and the anode is disposed in the anode chamber.

15. The apparatus of claim 13, wherein the fluid basin comprises a diffuser plate and the capacitive element is disposed on the diffuser plate.

16. The apparatus of claim 13, wherein the capacitive element is disposed near a periphery of the substrate.

17. The apparatus of claim 13, wherein the highly porous material of the capacitive element is carbon aerogel.

18. The apparatus of claim 13, wherein the capacitive element is adapted to a charging power supply configured to charge and discharge the capacitive element in a controlled manner without inducing electrochemical reactions.

19. The apparatus of claim 18, wherein the capacitive element is charged and discharged to achieve a desired profile across the substrate.

* * * * *

UNITED STATES PATENT AND TRADEMARK OFFICE

CERTIFICATE OF CORRECTION

PATENT NO. : 7,981,259 B2
APPLICATION NO. : 11/452839
DATED : July 19, 2011
INVENTOR(S) : Hafezi et al.

It is certified that error appears in the above-identified patent and that said Letters Patent is hereby corrected as shown below:

Column 5, Line 4, please delete "$i_p$" and insert --$i_p$-- therefor;

Column 5, Line 8, please delete "307" and insert --$307_1$-- therefor;

Column 5, Line 15, please delete "$i_c$" and insert --$i_c$-- therefor;

Column 5, Line 16, please delete "$i_c$" and insert --$i_c$-- therefor;

Column 5, Line 19, please delete "$i_p$" and insert --$i_p$-- therefor;

Column 5, Line 24, please delete "$i_c$" and insert --$i_c$-- therefor;

Column 5, Line 26, please delete "$i_c$" and insert --$i_c$-- therefor;

Column 7, Line 26, please delete "VB" and insert --$V_B$-- therefor;

Column 7, Line 26, please delete "II" and insert --III-- therefor.

Signed and Sealed this
Twenty-second Day of November, 2011

David J. Kappos

David J. Kappos
*Director of the United States Patent and Trademark Office*